US010239652B2

(12) United States Patent
Vanderhulst et al.

(10) Patent No.: US 10,239,652 B2
(45) Date of Patent: Mar. 26, 2019

(54) CONTAINER FOR EXAMINATION GLOVES

(71) Applicant: Medline Industries, Inc., Mundelein, IL (US)

(72) Inventors: Mark Vanderhulst, Chicago, IL (US); Jerome Shurell, Gurnee, IL (US); Danielle Carlin, Antioch, IL (US); Brianna Nelson, Palatine, IL (US); Reena Fernandes, Mundelein, IL (US)

(73) Assignee: Medline Industries, Inc., Northfield, IL (US)

( * ) Notice: Subject to any disclaimer, the term of this patent is extended or adjusted under 35 U.S.C. 154(b) by 303 days.

(21) Appl. No.: 15/265,391

(22) Filed: Sep. 14, 2016

(65) Prior Publication Data

US 2018/0072478 A1 Mar. 15, 2018

(51) Int. Cl.

| | |
|---|---|
| ***B65D 77/32*** | (2006.01) |
| ***B65D 85/18*** | (2006.01) |
| ***B65D 83/08*** | (2006.01) |
| ***B65D 5/10*** | (2006.01) |
| ***B65D 25/20*** | (2006.01) |
| ***B65D 5/42*** | (2006.01) |
| ***B65D 5/54*** | (2006.01) |

(52) U.S. Cl.

CPC ..... *B65D 5/103* (2013.01); *B65D 5/10* (2013.01); *B65D 5/4216* (2013.01); *B65D 5/541* (2013.01); *B65D 5/542* (2013.01); *B65D 83/0805* (2013.01); *B65D 85/18* (2013.01)

(58) Field of Classification Search

CPC ..... B65D 77/32; B65D 85/18; B65D 25/205; B65D 83/0805; A47K 10/426

USPC ..... 229/122, 240; 221/302, 305; 206/233, 206/438

See application file for complete search history.

(56) References Cited

U.S. PATENT DOCUMENTS

| | | | |
|---|---|---|---|
| 3,071,882 | A | 1/1963 | Eisman |
| 3,790,064 | A | 2/1974 | Kramer |
| 3,790,069 | A | 2/1974 | Straccamore |

(Continued)

FOREIGN PATENT DOCUMENTS

| | | |
|---|---|---|
| CA | 2132425 C | 1/2000 |
| KR | 3020060006367 | 2/2006 |

OTHER PUBLICATIONS

Household Tissue Boxes Paper Storage Box Tissue Box Holder, Online, published date unknown. Retrieved on Sep. 26, 2017 from URL: https://www.amazon.com/Household-Tissue Boxes-Storage-Holder/dp/B01L1K9Y36/ref=sr_1_11?ie=UTF8&qid=1506446688&sr=8-11&keywords=mirrored+tissue+box+cover.

(Continued)

*Primary Examiner* — Christopher Demeree

(74) *Attorney, Agent, or Firm* — Fitch, Even, Tabin & Flannery LLP

(57) ABSTRACT

Disclosed is a glove container that comprises a top portion, bottom portion, first and second side portions, and first and second end portions. When one of the end portions is torn away to reveal the contents of the container, at least one tab or flap containing visual indicia that indicates a characteristic of the contents of a container will remain attached to the container. The visual indicia may convey information such as the size or material of the gloves. The container is deemed particularly to suitable for use in emergency vehicles, where glove boxes are often stored in compartments with the end being exposed.

16 Claims, 11 Drawing Sheets

(56) References Cited

U.S. PATENT DOCUMENTS

| | | | | |
|---|---|---|---|---|
| 3,792,810 | A | 2/1974 | Tingley | |
| 3,970,215 | A * | 7/1976 | McLaren | A47K 10/421 221/45 |
| 4,199,097 | A | 4/1980 | Christensson | |
| 4,200,200 | A | 4/1980 | Hein | |
| D256,437 | S | 8/1980 | Faller | |
| D267,476 | S | 1/1983 | Boedeker | |
| RE33,979 | E | 6/1992 | Cortopassi | |
| D385,743 | S | 11/1997 | Eldridge | |
| D417,077 | S | 11/1999 | Sheu | |
| D423,359 | S | 4/2000 | MacLean | |
| D423,772 | S | 5/2000 | Cooper | |
| D429,437 | S | 8/2000 | Valenti | |
| D453,876 | S | 2/2002 | Moor | |
| D456,652 | S | 5/2002 | Smith | |
| D465,364 | S | 11/2002 | Childs | |
| D466,807 | S | 12/2002 | Buck | |
| D476,764 | S | 7/2003 | Khovaylo | |
| 6,681,983 | B2 | 1/2004 | Bill-Moore | |
| D488,298 | S | 4/2004 | Freeman | |
| 6,766,919 | B2 | 7/2004 | Huang | |
| D504,314 | S | 4/2005 | Kim | |
| D531,801 | S | 11/2006 | Sakaguchi | |
| D536,130 | S | 1/2007 | Jekel | |
| D552,428 | S | 10/2007 | Zeiron | |
| D553,977 | S | 10/2007 | Shiiya | |
| D553,978 | S | 10/2007 | Shiiya | |
| D563,219 | S | 3/2008 | Okin | |
| D587,998 | S | 3/2009 | Kaisanlahti | |
| D603,270 | S | 11/2009 | Kusumi | |
| D608,660 | S | 1/2010 | Mau | |
| D610,447 | S | 2/2010 | Seum | |
| D611,545 | S | 3/2010 | Williams | |
| D615,078 | S | 5/2010 | Bradley | |
| D617,127 | S | 6/2010 | Wang | |
| D619,015 | S | 7/2010 | Kusumi | |
| D619,098 | S | 7/2010 | Mike | |
| D622,590 | S | 8/2010 | Tayama | |
| D632,172 | S | 2/2011 | Harvey | |
| D635,454 | S | 4/2011 | Witte | |
| D637,497 | S | 5/2011 | Lee | |
| 8,006,893 | B2 | 8/2011 | Burke | |
| D644,979 | S | 9/2011 | Wenrick | |
| D647,791 | S | 11/2011 | Schmitt | |
| D649,040 | S | 11/2011 | Sanders | |
| D651,831 | S | 1/2012 | Becherer | |
| D651,908 | S | 1/2012 | Boyer | |
| D651,914 | S | 1/2012 | Boyer | |
| D652,295 | S | 1/2012 | Hipperson | |
| D652,311 | S | 1/2012 | Boyer | |
| D653,854 | S | 2/2012 | Chamberlain | |
| D655,189 | S | 3/2012 | Boyer | |
| D656,406 | S | 3/2012 | Boyer | |
| D656,836 | S | 4/2012 | Boyer | |
| D658,610 | S | 5/2012 | Bang | |
| D663,198 | S | 7/2012 | White | |
| D671,421 | S | 11/2012 | Lee | |
| D678,760 | S | 3/2013 | Cooper | |
| D678,762 | S | 3/2013 | Cooper | |
| D678,778 | S | 3/2013 | Lee | |
| D679,582 | S | 4/2013 | Witte | |
| D680,859 | S | 4/2013 | Levy | |
| D683,630 | S | 6/2013 | Lee | |
| D686,505 | S | 7/2013 | Uemura | |
| D687,706 | S | 8/2013 | Akana | |
| D688,560 | S | 8/2013 | Kwon | |
| D692,180 | S | 10/2013 | Dietvorst | |
| D693,678 | S | 11/2013 | Kanchan | |
| 8,646,653 | B2 | 2/2014 | Lien | |
| D702,765 | S | 4/2014 | Williams | |
| D706,129 | S | 6/2014 | Boraczek | |
| D706,627 | S | 6/2014 | Olsson | |
| D706,628 | S | 6/2014 | Palmer | |
| D706,640 | S | 6/2014 | Lee | |
| D708,069 | S | 7/2014 | Park | |
| D709,364 | S | 7/2014 | Olsson | |
| D709,953 | S | 7/2014 | Williams | |
| D711,601 | S | 8/2014 | Robbins | |
| D712,737 | S | 9/2014 | Gotur | |
| 8,881,903 | B2 | 11/2014 | Vulgamott | |
| D719,462 | S | 12/2014 | Kanda | |
| 9,085,406 | B2 * | 7/2015 | Decker | B65D 5/726 |
| D741,710 | S | 10/2015 | Katopo | |
| D742,243 | S | 11/2015 | Allen | |
| D749,414 | S | 2/2016 | Choi | |
| D749,962 | S | 2/2016 | Gorbatiuk | |
| D753,487 | S | 4/2016 | Wells | |
| D753,871 | S | 4/2016 | Aspgren | |
| D755,910 | S | 5/2016 | Randazzo | |
| D760,072 | S | 6/2016 | Lutz | |
| D760,434 | S | 6/2016 | Schmaelzle | |
| D768,481 | S | 10/2016 | Gagliardo | |
| D770,299 | S | 11/2016 | Andrews | |
| D776,457 | S | 1/2017 | Palmer | |
| D777,468 | S | 1/2017 | Currier | |
| D778,729 | S | 2/2017 | Spenceman | |
| D781,701 | S | 3/2017 | Brody | |
| D787,320 | S | 5/2017 | Gill | |
| D789,785 | S | 6/2017 | Fujiwara | |
| D793,229 | S | 8/2017 | Meneaud | |
| D796,562 | S | 9/2017 | Iu | |
| D804,943 | S | 12/2017 | Richmond | |
| 2003/0201276 | A1 * | 10/2003 | Fuller | B65D 83/0805 221/155 |
| 2005/0056690 | A1 | 3/2005 | Clapper | |
| 2006/0102706 | A1 | 5/2006 | Spivey | |
| 2006/0131370 | A1 | 6/2006 | Bates | |
| 2007/0210096 | A1 | 9/2007 | Ellswood | |
| 2014/0020700 | A1 | 1/2014 | Park | |
| 2014/0245266 | A1 * | 8/2014 | Sun | G06F 11/3664 717/124 |
| 2017/0073102 | A1 | 3/2017 | Borasi | |
| 2018/0022534 | A1 * | 1/2018 | McCormick | B65D 83/0805 206/278 |

OTHER PUBLICATIONS

Kleenex 21606CT White Facial Tissue. Online, published date unknown. Retrieved on Aug. 9, 2017 from URL: https://www.amazon.com/Kleenex-21606CT-F acial-Tissue-Pop-U p/dp/B0040ZOF2U/ref=pd_si m_ 328 _ 1 ? en cod i ng=UTF8&pd_rd_i=B0040ZOF2U&pd_rd_r= 1 PYH02PEVDBTT5RCQ4KB&pd_rd_ w=vlSal&pd_rd_ wg=gF q5l &psc= 1 &refRI D= 1 PYH02PEVDBTT5RC.

White Shabby Chic Vintage Roses Paper Napkin Box. Online, published date unknown. Retrirved on Aug. 9, 2017 from URL: https://lphandmade.com/en/shop/for-home-and-interior/white-shabby-chic-vintage-roses-paper-napkin-box/#.WYuQZP7rtmM.

Hale 275 Facial Tissue and Hygienic Glove Dispenser; Hale Manufacturing; product information from http://www.haleman.co.nz/facialtissueandhygenicglovedispensers/, publicly available at least as of Jul. 20, 2016.

Photo of Halyard Sterling SG Sensi-Guard Nitrile Exam Gloves, publicly available at least as of Jul. 20, 2016.

Photo of MediChoice® Large Nitrile Exam Gloves (box includes blue ink), publicly available at least as of May 5, 2016.

Photo-1 of MediChoice® Medium Nitrile Exam Gloves (box includes blue ink), publicly available at least as of May 5, 2016.

Photo of MediChoice® Small Latex Gloves (box includes blue ink), publicly available at least as of May 5, 2016.

Photo of MediChoice® X-Small Nitrile Exam Gloves (box includes blue ink), publicly available at least as of May 5, 2016.

Photo of MediChoice® X-Large Nitrile Exam Gloves (box includes green ink), publicly available at least as of May 5, 2016.

Photo of MediChoice® Small Stretch Vinyl Nitrile Exam Gloves (box includes green ink), publicly available at least as of May 5, 2016.

Photo-2 of MediChoice® Medium Nitrile Exam Gloves (box includes blue ink), publicly available at least as of May 5, 2016.

(56) References Cited

OTHER PUBLICATIONS

Photo-3 of MediChoice® Medium Nitrile Exam Gloves (box includes blue ink), publicly available at least as of May 5, 2016.
Photo of MediChoice® Large Vinyl Nitrile Exam Gloves (box includes orange ink), publicly available at least as of May 5, 2016.
Photo of MediChoice® Medium Latex Gloves (box includes purple ink), publicly available at least as of May 5, 2016.
Surface-Mounted Stainless Steel Tissue Dispenser, Model 987-11; Bradley Corporation; product information from http://bradleycorp.com/accessories/specialty/hospitality/tissue-dispenser/, publicly available at least as of Jul. 20, 2016.

* cited by examiner

CONTAINER FOR EXAMINATION GLOVES

TECHNICAL FIELD

The invention is in the field of containers, and in certain embodiments relates to a container used to contain and dispense medical gloves.

BACKGROUND OF THE INVENTION

Medical gloves, such as, examination gloves, are used in a variety of settings, including clinical and emergency medical service ("EMS") settings. Such gloves are typically packaged and dispensed from disposable containers, each container holding a quantity of gloves. Medical gloves are available in various materials, colors, and sizes. With this variety of options available for gloves, it is important that the containers are clearly labeled so that the user can easily determine what types of gloves are in the container. As an example, some patients or users may have an allergy to latex, so it would be very important to indicate on the container of gloves whether the gloves are composed of a latex material. In many settings, a selection of gloves may be made available for users. For example, several different sizes of gloves may be required to accommodate users who require different glove sizing. Conventional medical glove containers are labeled with indicia on the outside of the container, for example, on the top and side panels of the container.

Conventional medical glove containers have a rectangular cross section and have a perforated opening panel on the top side of a rectangular container of gloves. Gloves are dispensed from the box by removal of the opening panel, which allows the user to reach into the container and pull individual gloves out of the container through the opening. In clinical settings, the indicia printed on the glove containers may be easily visible as the containers are laid out on a flat table or on a shelf. When the perforated oval opening of the glove container is removed, the indicia are still visible on the top, ends, or sides of the container.

In EMS (ambulatory, fire, or other first responder) settings, however, glove containers may be inserted into an ambulance console with the short end of the container facing outward and the other sides of the container obscured by the console. When EMS personnel wish to remove a glove from the container, they may but tear the exposed end of the box off the container to access the gloves inside the box. Once the end of the container has been removed, there are no indicia clearly visible to the EMS personnel that communicate information about the gloves within the container, because no other sides or ends of the container are visible. Because of the nature of EMS work, personnel often do not have the time to remove the containers from their stowed position to read the indicia on the intact portion of the container.

Generally, it has now been found that a container that comprises a top panel, a bottom panel, first and second side panels, first and second outer end panels, optionally and first and second inner end flaps proximal the first and second outer end flaps, may be provided. When one of the end portions is torn away to reveal the contents of the container, at least one tab or flap containing visual indicia that indicates a characteristic of the contents of a container will remain attached to the container. For example, at least one of the first and second inner end flaps include perforations separating the inner end flaps into first and second removable portions and first and second fixed portions respectively. In use, the first and second removable portions may be torn away from the end flaps along the perforations, thereby exposing the contents of the container while the first and second fixed portions remain attached to the first and second side panels of the container. The first and second fixed portions include visible indicia conveying information about the contents of the gloves, for example, the size of the gloves contained in the container. In this manner, the container is open to allow gloves to be removed from the end of the container, but the first and second fixed portions and their corresponding visible indicia remain attached to the container and functioning as tabs or flaps that remain visible to the user.

In another embodiment, a container blank is provided. The blank generally comprises panel portions corresponding to the panels of the container described above, and is suitable for folding into a container as described herein.

In another embodiment, a method of forming the glove container described above is provided. This method comprises providing a blank made from a foldable material, such as cardboard, and folding the container to assemble it into a finished container. The container may then be filled with examination gloves and deployed for use in the field.

In another embodiment, a method of accessing gloves is provided. The method generally comprises providing a glove container and removing an end portions thereby creating an access point for the gloves and leaving a tab or flap with visual indicia conveying information about the contents of the gloves.

DETAILED DESCRIPTION

In general a glove container having a top panel, bottom panel, first and second side panels, and first and second outer end panels is provided. In the illustrated embodiments, optional inner end panels may be included. The first outer end panel may be torn away from the container to reveal a first inner end panel. The first inner end panel may be torn away from the container to reveal first and second inner end flaps. The first and second inner end flaps interlock with one another and cooperate with the first inner end panel to provide rigidity. The first and second inner end flaps include first and second removable portions and first and second fixed portions respectively. The first and second removable portions of the first and second inner end flaps may be removed to reveal the contents of the container. The first and second fixed portions of the first and second inner end flaps remain attached and include visual indicia to provide information about the contents of the gloves in the container.

The container may be formed of a foldable cardboard or other cardstock material. The container may be assembled in part using glue, and the panels may include interlocking tabs and hooks to maintain the assembly of the container. The container may include artwork and other indicia indicating the contents of the container. The container may be formed from a blank of foldable material. The blank of foldable material may be printed with necessary indicia and artwork, and processed to include fold lines about which the various panels of the container may be folded. Conventional techniques may be used to cut the blank from a blank sheet and create the fold lines and subsequently to assemble and fill the container.

Figure 1:
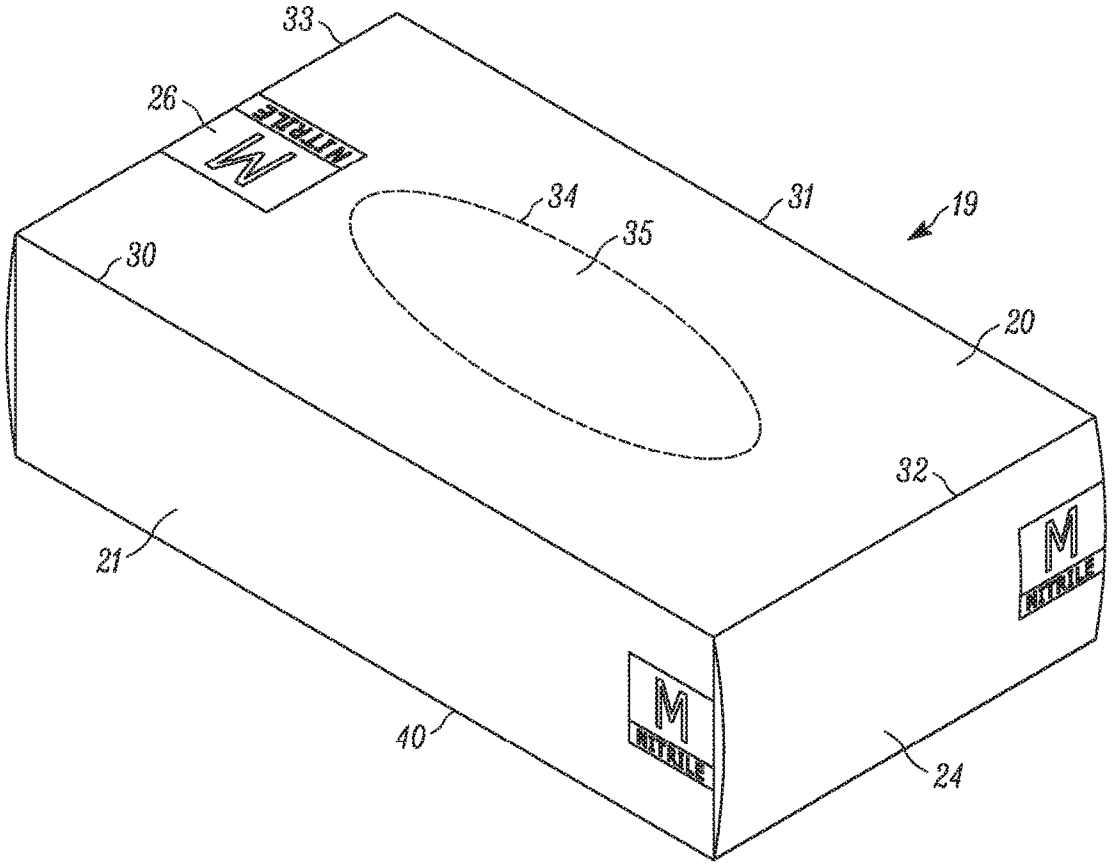
FIG. 1 is a perspective view of a glove container in accordance with one embodiment.
Figure 2:
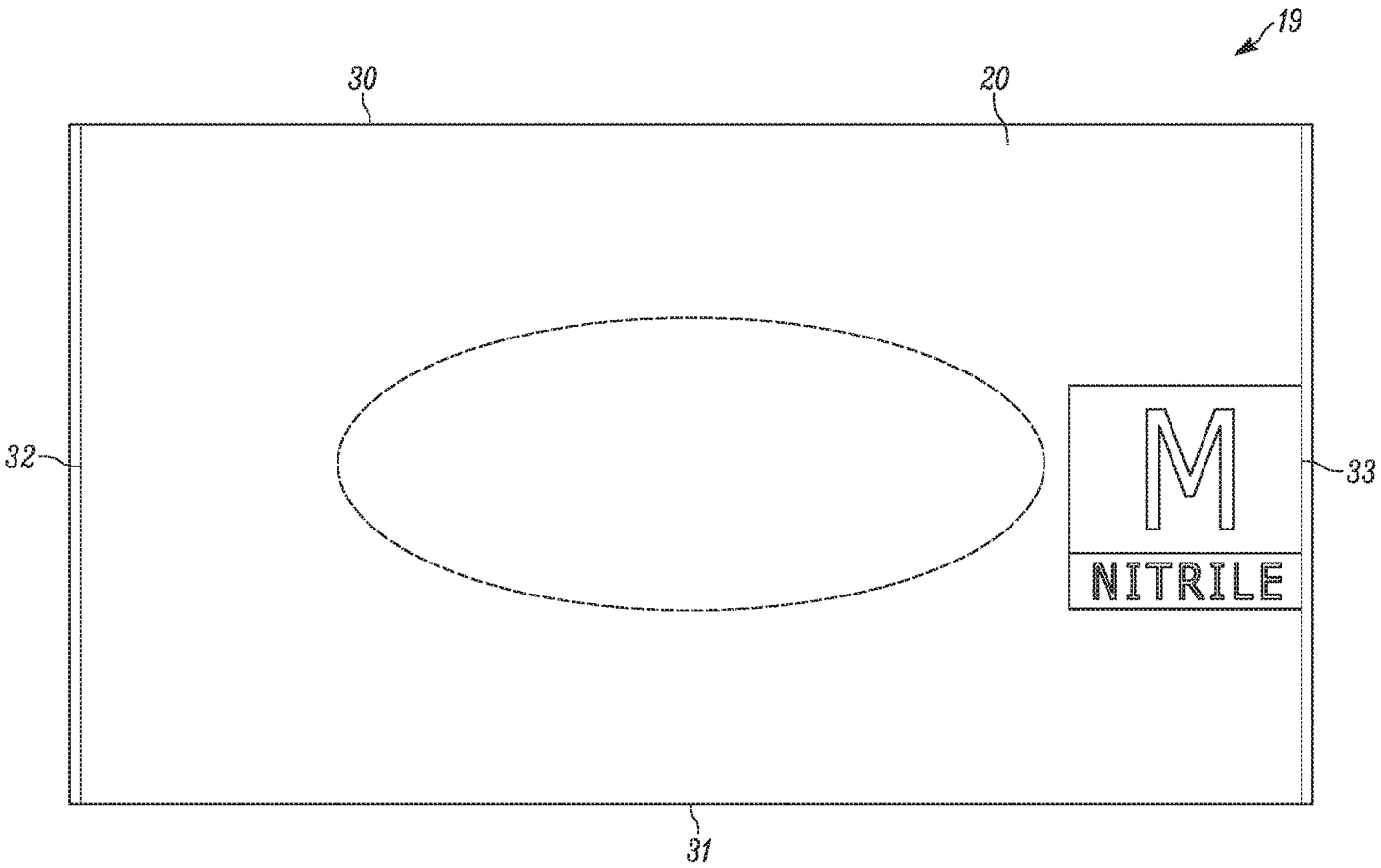
FIG. 2 is a top plan view of the glove container shown in FIG. 1.
Figure 3:
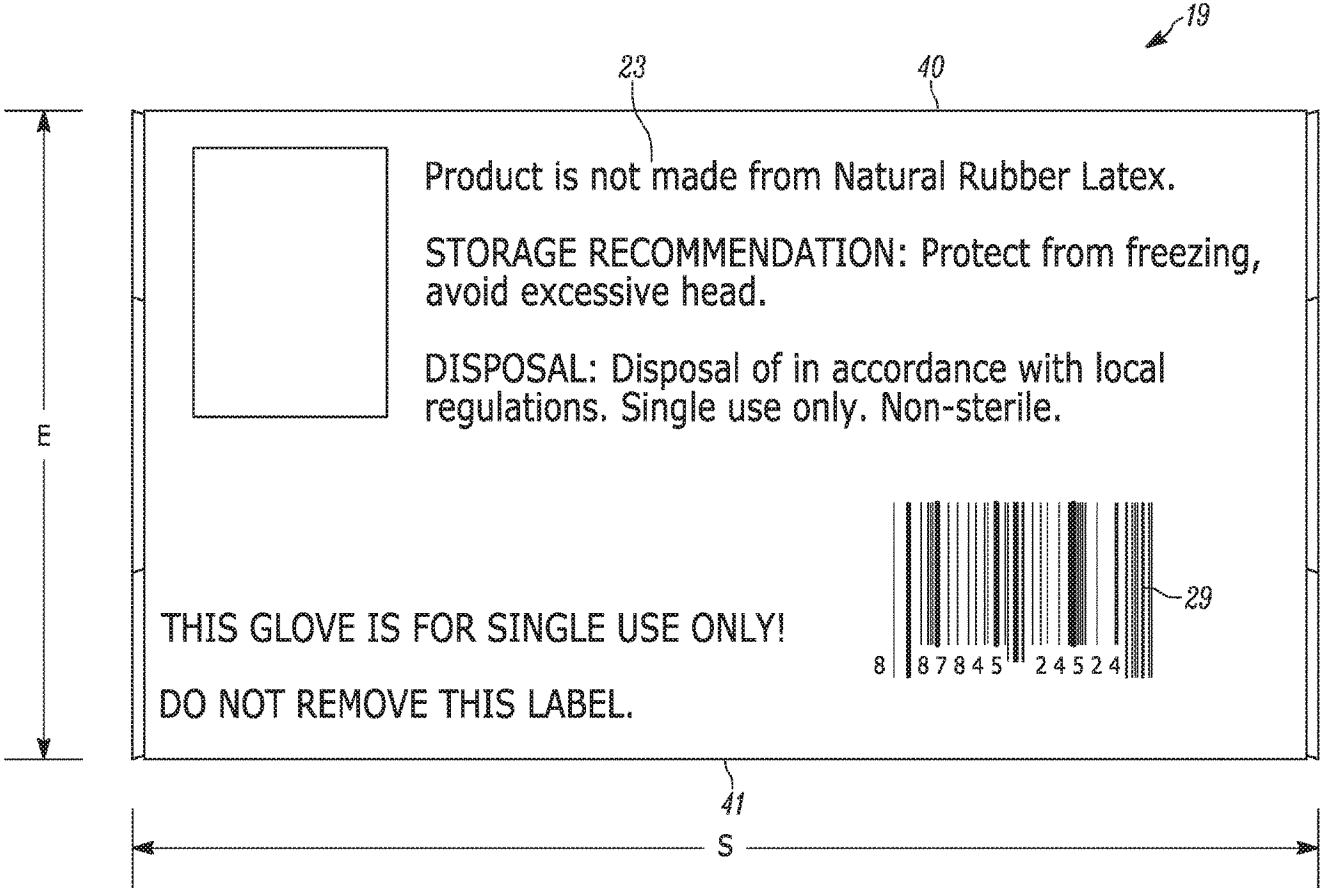
FIG. 3 is a bottom plan view of the glove container shown in FIG. 1.
Figure 4:
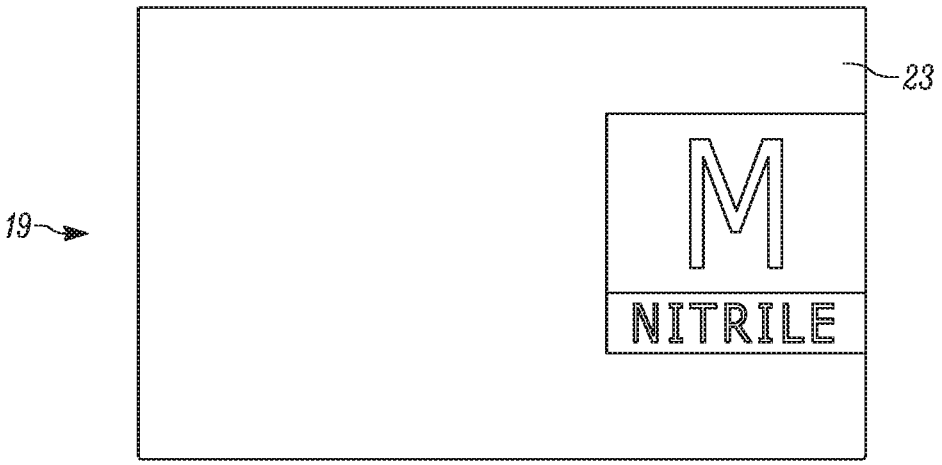
FIG. 4 is a first end elevational view of the glove container shown in FIG. 1.
Figure 5:
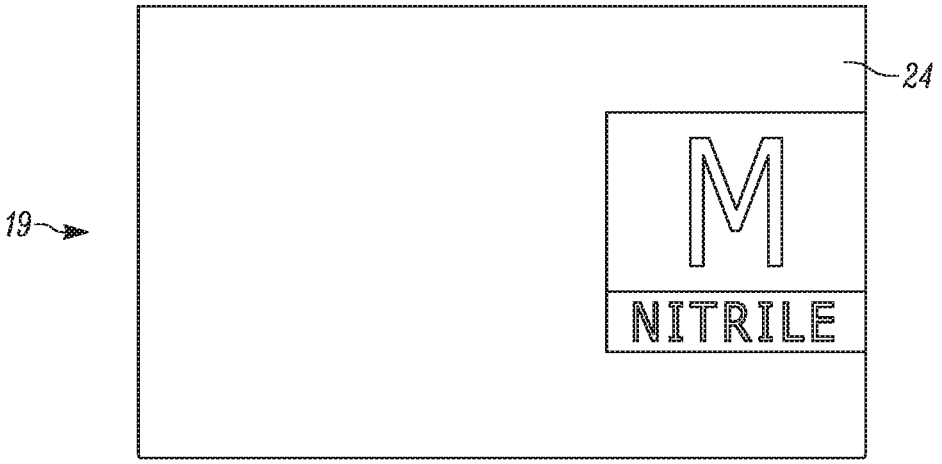
FIG. 5 is a second end elevational view of the glove container shown in FIG. 1.
Figure 6:
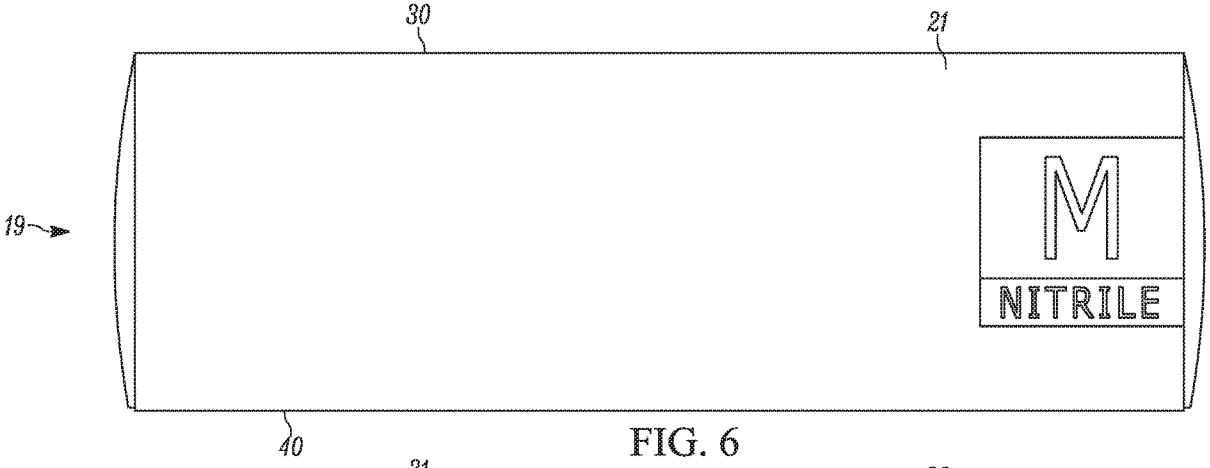
FIG. 6 is a first side elevational view of the glove container shown in FIG. 1.
Figure 7:
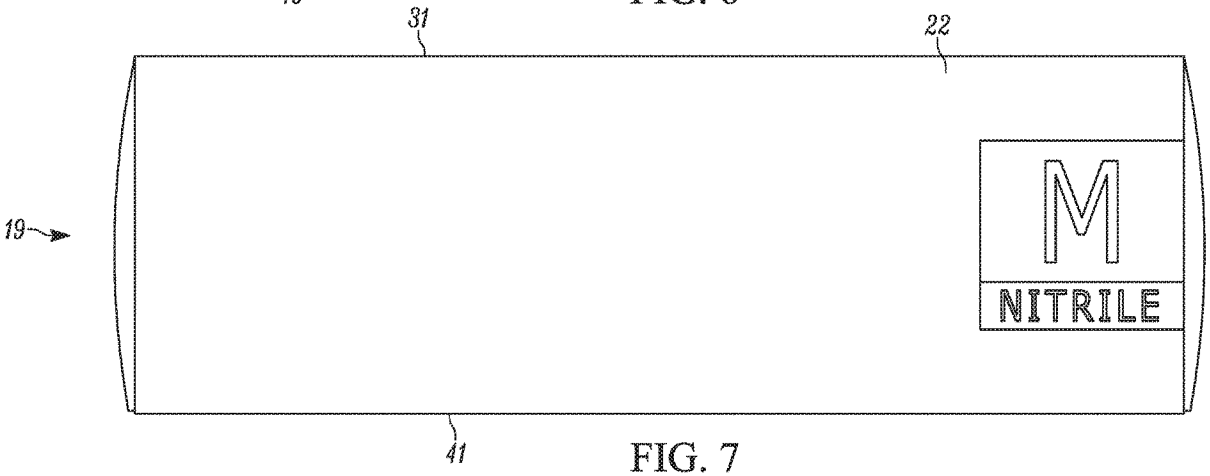
FIG. 7 is a second side elevational view of the glove container shown in FIG. 1.

As depicted variously in FIGS. 1-7, the exemplary glove container 19 includes a top panel 20, a first side panel 21, a second side panel 22, a bottom panel 23, a first outer end panel 24, and a second outer end panel 25. The top panel 20 is connected to the first and second side panels 21 and 22, respectively, along first and second top side edges 30 and 31, respectively. The first outer end panel 24 is connected to the top panel 20 along a first top end edge 32. The second outer end panel 25 is connected to the top panel 20 along a second top end edge 33. The top panel 20 includes perforations 34 defining a removable top access opening panel 35. As depicted in FIG. 3, the glove container 19 includes a first bottom side edge 40 and a second bottom side edge 41, these edges connecting the bottom panel 23 to the side panels 21, 22 respectively. The outer end panels each have an outer end panel width and the side panels each have a side panel width. As shown in FIG. 3, the side panel width S is greater than the end panel E width in the illustrated embodiment.

The top and side panels include visual indicia (e.g. indicia 26 in FIG. 1) that convey information about the gloves, for example, size and/or material information. The indicia may comprise lettering (e.g. size codes such as "S," "M," "L," "XL," etc.), or color-coding, or words indicating the glove material (e.g. "nitrile," "latex," etc.), or any combination thereof, or other suitable indicia. As seen in FIG. 3, the bottom panel 23 includes a bar code 29 and product information or other suitable information, which information alternatively may be placed elsewhere on the container.

Figure 8:
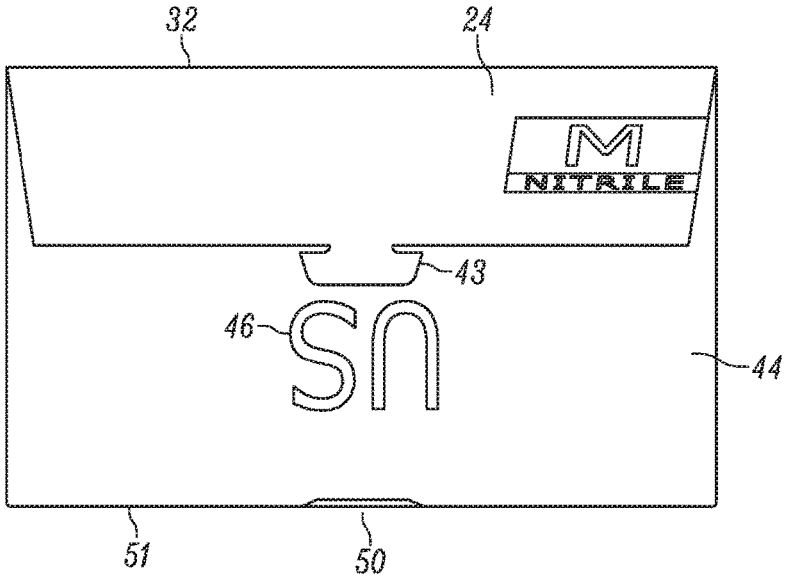
FIG. 8 is a first end elevational view of the glove container shown in FIGS. 1 and 4 with the first outer end panel partially lifted.

As depicted in FIG. 8, the first outer end panel 24 includes a tab 43, which is visible once the outer end panel 24 has been lifted. The glove container 19 further includes a first inner end panel 44 connected to the bottom panel 23 along first bottom end edge 45. When assembled, the first inner end panel 44 is covered by the first outer end panel 24, and the tab 43 is inserted into a first end slot 50 formed in the first inner end panel 44 along the first bottom end edge 45. In use, the tab 43 of the first outer end panel 24 may be removed from the first end slot 50 of the first inner end panel 44 and the first outer end panel 24 may be folded along the first top end edge 32 to reveal the first inner end panel 44.

Figure 9:
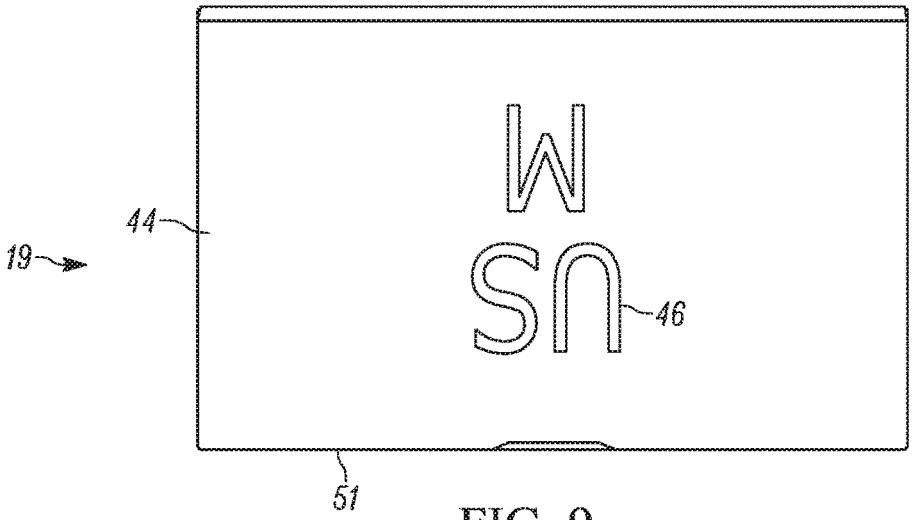
FIG. 9 is an elevational view similar to FIG. 8 but with the first outer end panel torn away.
Figure 10:
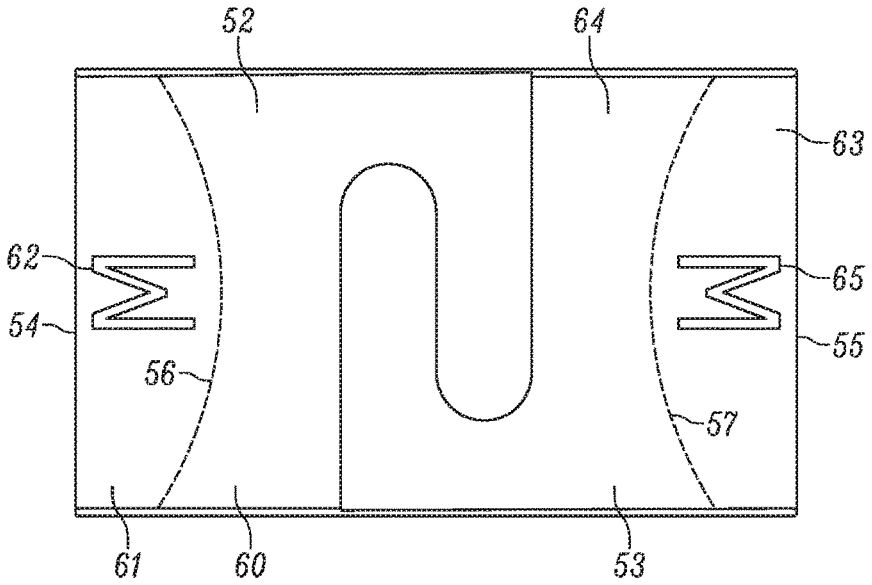
FIG. 10 is an elevational view similar to FIGS. 8 and 9 but with the first inner end panel also torn away from the container.

As depicted in FIGS. 9 and 10, when the first outer end panel (not shown in FIG. 9) has been torn away from the glove container 19 along the first top end edge 32, the first inner end panel 44 may be torn away from the glove container 19 along the first bottom end edge 45 to reveal the first and second inner end flaps 52 and 53 as depicted in FIG. 10.

As seen in FIGS. 8 and 9, the first inner end panel 44 may include visible indicia 46 providing information about the contents of the container. In addition, the first inner end panel 44 may be lifted from the glove container 19, and instead of tearing the first inner end panel 44 away from the glove container 19, the first inner end panel may remain attached to the container for purposes of re-closing the container.

As depicted in FIG. 10, the first and second inner end flaps 52 and 53 are connected to first and second side edges 54 and 55 respectively. The first inner end flap 52 is connected to the first side panel 21 along the first side edge 54. The glove container 19 also includes a second inner end flap 53 which is connected along the second side edge 55 to the second side panel 22. The first inner end flap 52 includes a first removable portion 60 and a first fixed portion 61, and the second inner end flap 53 includes a second fixed portion 63 and a second removable portion 64. A first visual indicia 62 is printed on the first fixed portion 61 of the first inner end flap 52 and a second visual indicia 65 is printed on the second fixed portion 63. The visual indicia 62, 65 provides visible information regarding the glove container 19. The first fixed portion 61 of the first inner end flap 52 is separated from the first removable portion 60 of the first inner end flap 52 by perforations 56. Similarly, the second fixed portion 63 of the second inner end flap 53 is separated from the second removable portion 64 of the second inner end flap 53 by perforations 57. First and second removable portions 60 and 64 of the first and second inner end flaps 52 and 53 are configured such that their ends may be interlocked and temporarily connected to provide rigidity to the container and to prevent gloves from being inadvertently dispensed from the container. Other configurations are possible. For example, the fixed portions 61, 63 may have a rectilinear shape instead of a curved boundary.

The visual indicia 62, 65 on the first and second inner end flaps 52 and 53 can correspond to any relevant information regarding the contents of the container. The visual indicia may relate to the material properties of the contents, sizing information regarding the gloves, the color of the gloves, or any other information that would be useful regarding the contents of the glove container. The indicia may contain the same information as the other indicia on the container (e.g. size and material) or may contain less or different information (e.g. size only). In an alternative embodiment of the invention, the first and second removable portions 60 and 64 may be glued together by an adhesive material instead of connected in an interlocking fashion. However, the interlocking configuration may be advantageous in certain applications because the interlocking feature eliminates the need for adhesive on this portion of the cardstock material. Moreover, the adhesive may not be appropriate in damp environments and may make it more difficult to collapse the container for purposes of discarding the container after the container is emptied of its contents. In another embodiment, the first and second removable portions may simply be folded in proximity to one another rather than being connected by any interlocking features or adhesive.

In another embodiment, the container may include only a first or second inner end flap connected to one of the first or second side edges 54 or 55 that extends partly or fully across the end of the container, in which case a single removable portion and a single fixed portion is located proximate the end of the container.

As shown in FIG. 10, first and second visual indicia 62 and 65 are included on first and second fixed portions 61 and 63 and oriented in opposing fashion, such that one or the other of the first and second visual indicia 62 and 65 will be oriented right-side down or right-side right regardless of the orientation of the glove container 19.

Figure 11:
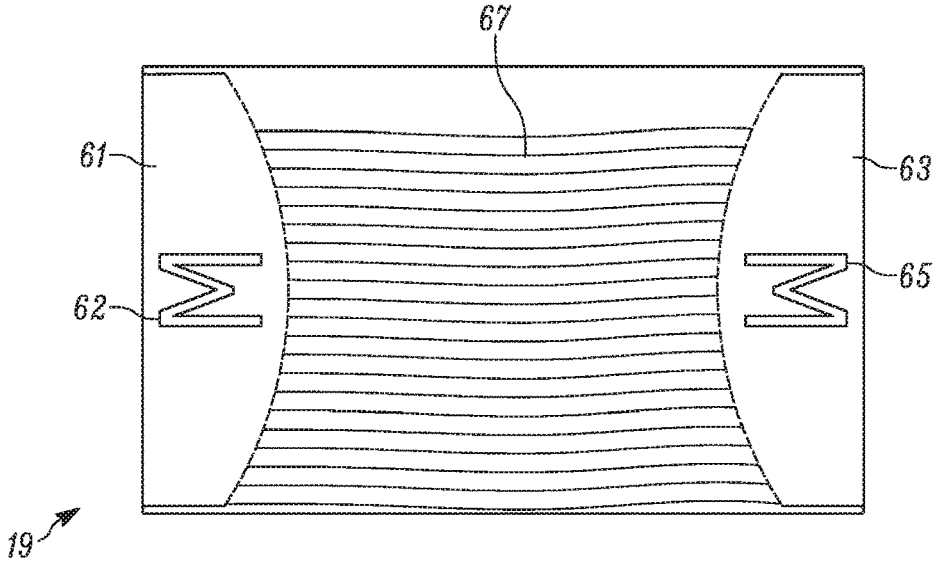
FIG. 11 is an elevational view similar to FIGS. 8-10 but with the first and second removable portions of the first and second inner end flaps removed to reveal the contents of the container.

As depicted in FIG. 11, first and second removable portions 60 and 64 (shown in FIG. 10 but not 11) may be torn away along perforations 56 and 57 to reveal the gloves 67 that are inside the glove container 19. First and second fixed portions 61 and 63 with first and second visual indicia 62 and 65 remain intact and attached to the glove container 19 to provide information about the contents of the gloves inside the glove container 19. In use, the gloves may be pulled from the end of the glove container 19 while the first and second fixed portions 61 and 63 remain visible while the glove container is stowed with the end facing outward, even after the first outer end panel 24, the first inner end panel 44, and the removable portions 60 and 64 of the first and second inner end flaps 52 and 53 have been removed and discarded. The first and second fixed portions 61 and 63 thereby function as tabs or flaps containing the visual indicia that conveys information about the contents of the container even when the end of the container is exposed to allow access to the gloves inside the container.

Figure 12:
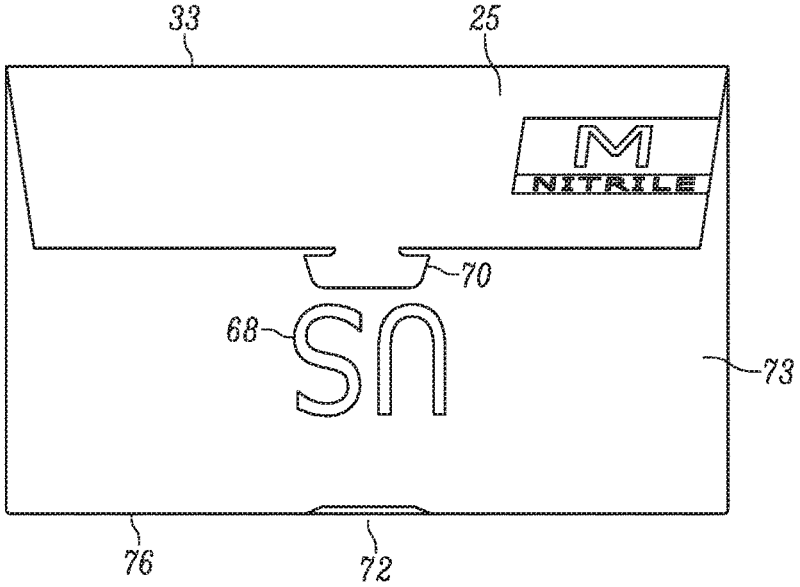
FIG. 12 is a second end elevational view of the glove container of FIG. 1 showing the second end panel partially lifted.
Figure 13:
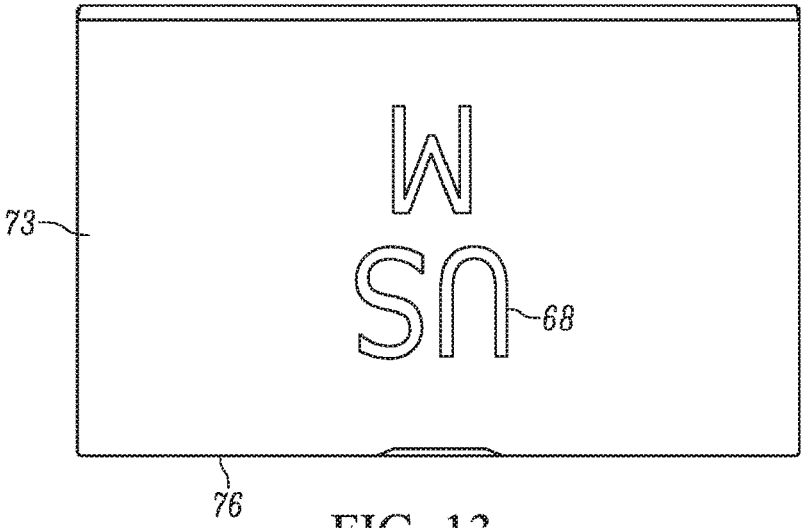
FIG. 13 is an elevational view showing the second outer end panel torn away from the container.
Figure 14:
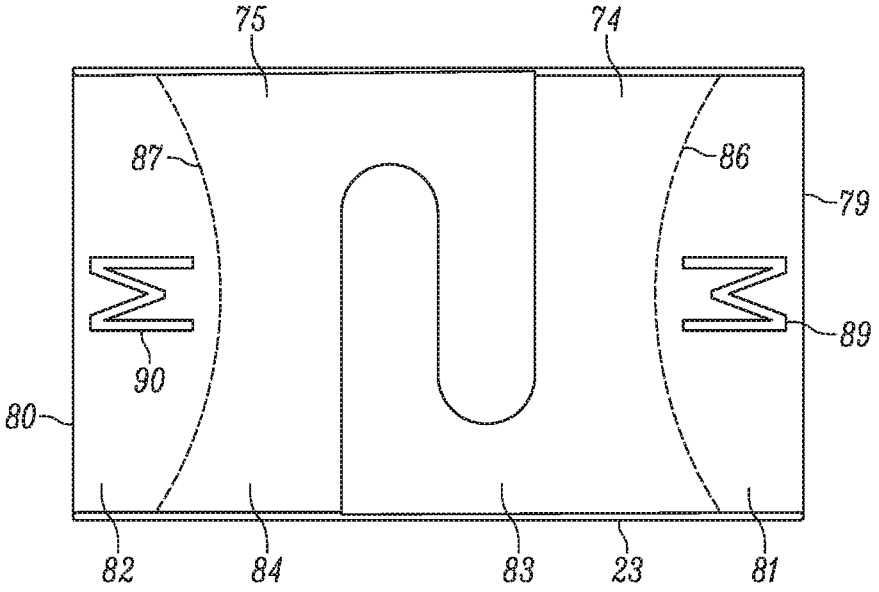
FIG. 14 is an elevational view showing the second inner end panel torn away from the container.

The opposite end of container 19 is similarly configured and may include a removable outer end panel and removable inner end panels and inner end flaps similar to those described above. FIG. 12 depicts the second outer end panel 25 and a second tab 70 along the second top end edge 33. The second outer end panel 25 may be lifted up along the second top edge 33 by removing the tab 70 from a second slot 72. When the second outer end panel 25 is lifted, a second inner end panel 73 is exposed which is connected to the bottom panel 23 (not visible) along the second bottom end edge 76. The second outer end panel 25 may be torn away from the top panel (not visible) along a second top edge 71 as shown in FIG. 13. As shown in FIGS. 13 and 14, second inner end panel 73 (shown in FIG. 13 but not FIG. 14) may be torn away along the second bottom end edge 76 from the bottom panel 23.

As with the first inner end panel 44, the second inner end panel 73 may include visible indicia 68 providing information about the contents of the container. In addition, the second inner end panel 73 may be lifted from the glove container 19, and instead of tearing away this panel, the second inner end panel 73 away from the glove container 19 the second inner end panel may remain attached to the container for purposes of re-closing the container.

As shown in FIG. 14, when second inner end panel 73 is torn away, third and fourth inner end flaps 74 and 75 are revealed. The third and fourth inner end flaps 74 and 75 are connected to the first and second side panels 21 and 22 along third and fourth side edges 79 and 80 respectively. Third and fourth inner end flaps 74 and 75 temporarily conceal the contents of the glove container 19 and provide rigidity. The third and fourth inner end flaps 74 and 75 include third and fourth fixed portions 81 and 82 and third and fourth removable portions 83 and 84. The third and fourth fixed portions 81 and 82 are separated from the third and fourth removable portions 83 and 84 by perforations 86 and 87, respectively. The third and fourth removable portions 83 and 84 are configured to interlock with one another. As discussed above with respect to the first and second removable portions 60 and 64, in another embodiment third and fourth removable portions may be connected by an adhesive or may simply be folded in proximity of one another. In another embodiment, third and fourth inner end flaps 74 and 75 may be replaced by a single inner end flap.

As shown in FIG. 14, the third and fourth fixed portions 81 and 82 include third and fourth visual indicia 89 and 90. As discussed with respect to FIG. 10, the third and fourth visual indicia shown in FIG. 14 provide information about the contents of the glove container 19. The third and fourth visual indicia 66 and 67 are oriented in an opposing fashion for the reasons discussed above with respect to FIG. 10. Third and fourth removable portions 83 and 84 may be torn away along perforations 86 and 87 to reveal the contents of the glove container 19.

Figure 15:
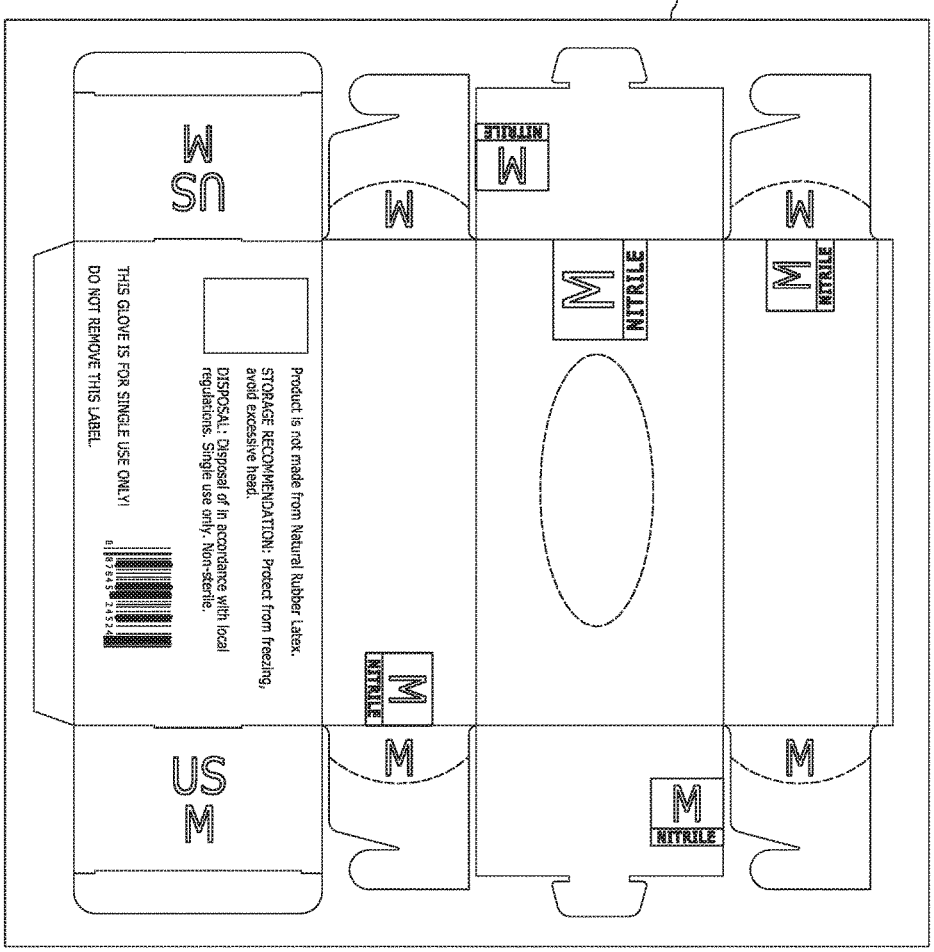
FIG. 15 is a plan view of printed blank sheet useful for forming the glove container shown in FIG. 1.
Figure 16:
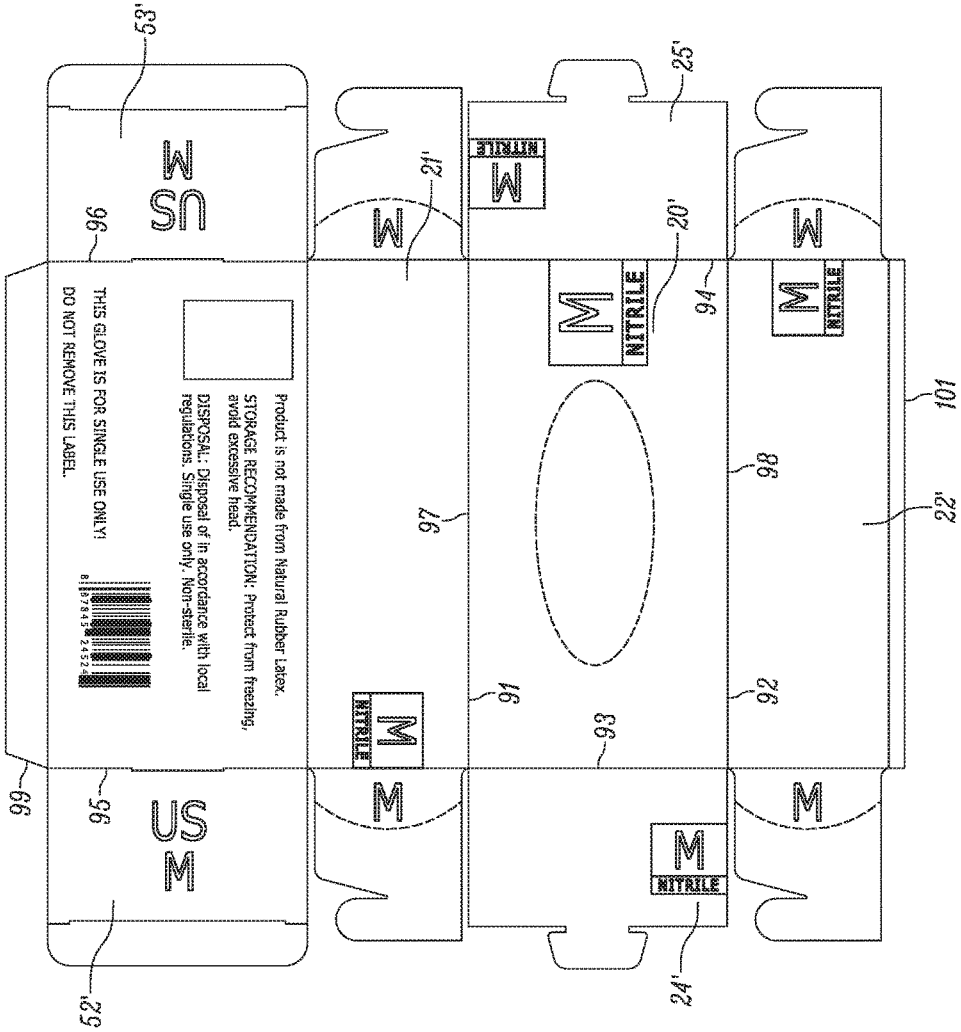
FIG. 16 is a top plan view of a blank cut from the blank sheet shown in FIG. 15.

As shown in FIG. 15, an embodiment of a container printed blank sheet 85 is shown. Blank sheet 85 is formed from a cardboard material and, as shown, the various panels forming the glove container 19 are situated about the blank sheet 85 with corresponding visual indicia and other artwork printed on the various panel portions of the blank sheet 85. The glove container blank 100 shown in FIG. 16 is constructed by cutting the blank sheet along the cut lines and forming the folds and perforations. Generally, the shapes of the container panels are demarcated by cut lines and fold lines, the cut lines designating where the material will be cut and the fold lines designating where a fold will be impressed or scored into the material.

As shown in FIG. 16, the top panel portion 20' is connected to the first and second side panel portions 21' and 22' at first and second fold lines 91 and 92, respectively. The top panel portion 20' is also connected to the first and second outer end panel portions 24' and 25' at third and fourth fold lines 93 and 94, respectively. The first inner end panel portion 44' is connected to the bottom panel portion 23' at a fifth fold line 95. The second inner end panel portion 73' is connected to the second side panel portion 22' at a sixth fold line 96. The bottom panel portion 23' is connected to the first side panel portion 21' at seventh fold line 97. Inner end flap portions 52', 74' are connected to the first side panel portion 21' at fold lines 98, 99 respectively, while inner end flap portions 53', 75' are connected to the second side panel portion 22' at fold lines 100, 101 respectively.

Once the blank 100 has been cut from the blank sheet 85, the container may be assembled by folding the various panel portions along the fold lines and filling the container with gloves. Adhesive may be applied to one or both of the side tabs 102, 103 to secure them to one another. In use, the outer and inner end panels are removed or folded away and the inner end flaps are removed to allow access to the contents of the container, leaving the fixed portions as tabs or flaps.

Also encompassed in an embodiment is a set of glove container, each of the glove containers containing a plurality of gloves, the gloves having at least one different characteristic from box to box. For instance, a set of glove containers may comprise gloves that are otherwise identical but of different sizes (for instance, the set of glove containers may include small, medium, large, extra-large, and doubleextra-large gloves). Each of the containers is a container as described hereinabove, and preferably is otherwise structurally identical. A set of containers may be sold as a package or may be formed in situ via the placement of plural glove containers in a single vehicle or in a single enclosed room.

The illustrated glove container is believed to provide a container that is advantageous in EMS or other settings where a typical glove container including indicia only on the outside panels of the container may not be suitable. It is contemplated that the box may be suitable for contents other than gloves in some embodiments.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A glove container comprising:

a top panel, a bottom panel, first and second side panels, first and second outer end panels, and first and second inner end flaps proximal said first end panel;

said top panel being joined to said first and second side panels at first and second top side edges respectively;

said top panel being joined to said first and second outer end panels at first and second top end edges respectively;

said first inner end flap being connected to said first side panel at a first side edge;

said second inner end flap being connected to said second side panel at a second side edge;

said bottom panel being joined to said first and second side panels at first and second bottom side edges respectively;

said top panel, bottom panel, first and second side panels, and first and second outer end panels defining a container, said container including a plurality of gloves;

said first and second inner end flaps being configured to interlock with one another;

said first inner end flap including perforations separating said first inner end flap into a first removable portion and a first fixed portion;

said second inner end flap including perforations separating said second inner end flap into a second removable portion and a second fixed portion;

said first fixed portion including first visual indicia corresponding to a characteristic of said plurality of gloves, said first visual indicia being visible upon removal of said first outer end panel and upon removal of said first and second removable portions of said first and second inner end flaps.

2. A glove container according to claim 1, said second fixed portion including second visual indicia corresponding to a characteristic of said plurality of gloves, said second visual indicia being visible upon removal of said first outer end panel and upon removal of said first and second removable portions of said first and second inner end flaps.

3. A glove container according to claim 2, said second visual indicia oriented in generally opposing fashion to said first visual indicia but otherwise being identical to said first visual indicia.

4. A glove container according to claim 1, including third and fourth inner end flaps proximal said second outer end panel;

said third inner end flap being connected to said fourth side panel at a third side edge;

said fourth inner end flap being connected to said second side panel at a fourth side edge;

said third and fourth inner end flaps being configured to interlock with one another;

said third inner end flap including perforations separating said third inner end flap into a third removable portion and a third fixed portion;

said fourth inner end flap including perforations separating said fourth inner end flap into a fourth removable portion and a fourth fixed portion;

said third fixed portion including third visual indicia corresponding to a characteristic of said plurality of gloves, said third visual indicia being visible upon removal of said second outer end panel and upon removal of said third and fourth removable portions of said third and fourth inner end flaps.

5. A glove container according to claim 4, said fourth fixed portion including fourth visual indicia corresponding to a characteristic of said plurality of gloves, said fourth visual indicia being visible upon removal of said second outer end panel and upon removal of said first and fourth removable portions of said first and fourth inner end flaps.

6. A glove container according to claim 1, including a first inner end panel, said first inner end panel being proximal said first outer end panel, said first inner end panel being connected to said bottom end panel at a first bottom end edge.

7. A glove container according to claim 6, said first bottom end edge including a first end slot, said first outer end panel including a first tab configured for locking insertion into said first end slot.

8. A glove container according to claim 6, including a second inner end panel, said second inner end panel being proximal said second outer end panel, said second inner end panel being connected to said bottom end panel at a second bottom end edge.

9. A glove container according to claim 8, said second bottom end edge including a second end slot, said second outer end panel including a second tab configured for locking insertion into said second end slot.

10. A glove container according to claim 1, said top panel including perforations defining a removable access panel.

11. A glove container according to claim 1, said outer end panels each having an outer end panel width and said side panels each having a side panel width, said side panel width being greater than said end panel width.

12. A glove container comprising:

a top panel, a bottom panel, first and second side panels, first and second outer end panels, and first and second inner end flaps proximal said first end panel;

said top panel being joined to said first and second side panels at first and second top side edges respectively;

said top panel being joined to said first and second outer end panels at first and second top end edges respectively;

said first inner end flap being connected to said first side panel at a first side edge;

said second inner end flap being connected to said second side panel at a second side edge;

said bottom panel being joined to said first and second side panels at first and second bottom side edges respectively;

said top panel, bottom panel, first and second side panels, and first and second outer end panels defining a container, said container including a plurality of gloves;

said first and second inner end flaps being configured to interlock with one another;

said first inner end flap including perforations separating said first inner end flap into a first removable portion and a first fixed portion;

said second inner end flap including perforations separating said second inner end flap into a second removable portion and a second fixed portion;

said first fixed portion including first visual indicia corresponding to a characteristic of said plurality of gloves, said first visual indicia being visible upon removal of said first outer end panel and upon removal of said first and second removable portions of said first and second inner end flaps;

said second fixed portion including second visual indicia corresponding to a characteristic of said plurality of gloves, said second visual indicia being visible upon removal of said first outer end panel and upon removal of said first and second removable portions of said first and second inner end flaps;

third and fourth inner end flaps proximal said second outer end panel;

said third end flap being connected to said side panel at a third side edge; said fourth end flap being connected to said second side panel at a fourth side edge;

said third and fourth inner end flaps being configured to interlock with one another;

said third inner end flap including perforations separating said third inner end flap into a third removable portion and a third fixed portion;

said fourth inner end flap including perforations separating said fourth inner end flap into a fourth removable portion and a fourth fixed portion;

said third and fourth fixed portions including third and fourth visual indicia respectively corresponding to a characteristic of said plurality of gloves, said third and fourth visual indicia being visible upon removal of said second outer end panel and upon removal of said third and fourth removable portions of said third and fourth inner end flaps;

a first inner end panel proximal said first outer end panel, said first inner end panel connected to said bottom end panel at a first bottom end edge, said first bottom end edge including a first end slot and said first outer end panel including a first tab configured for locking insertion into said first end slot;

a second inner end panel proximal said second outer end panel, said second inner end panel being connected to said bottom end panel at a second bottom end edge and said second bottom end edge including a second end slot, said second outer end panel including a second tab configured for locking insertion into said second end slot;

said top panel including perforations defining a removable access panel;

said outer end panels each having an outer end panel width and said side panels each having a side panel width, said side panel width being greater than said end panel width.

13. A glove container, the container comprising:

a top panel, a bottom panel, first and second side panels, first and second outer end panels, and an inner end flap proximal said first end panel;

said outer end panels each having an outer end panel width and said side panels each having a side panel width, said side panel width being greater than said end panel width;

said container comprising at least one inner tab or flap containing visual indicia that indicates a characteristic of the contents of the container, said container being constructed such that said at least one tab or flap will remain attached to the container when an end panel is removed to allow access to the contents of the container.

14. A blank for forming a glove container, the blank comprising:

a sheet of material including a top panel portion, a bottom panel portion, first and second side panel portions, first and second outer end panel portions, and first and second inner end flaps panel portions proximal said first end panel;

said top panel portion being connected to said first and second side panel portions at first and second fold lines respectively;

said top panel portion being connected to said first and second outer end panels at third and fourth fold lines respectively;

said first end flap portion being connected to said first side panel portion at fifth fold line;

said second end flap portion being connected to said second side panel portion at sixth fold line;

said bottom panel portion being connected to one of said first and second side panel portions at a seventh fold line;

said top panel portion, a bottom panel portion, first and second side panel portions, and first and second outer end panels being foldable along said first, second, third, fourth, fifth, sixth, and seventh fold lines to define a container;

said first and second inner end flap portions being configured to interlock with one another;

said first inner end flap portion including perforations separating said first inner end flap portion into a first removable portion and a first fixed portion;

said second inner end flap portion including perforations separating said second inner end flap into a second removable portion and a second fixed portion;

said first and second fixed portions including first and second visual indicia.

15. A blank according to claim 14, said top panel portion comprising perforations defining a removable access panel.

16. A blank according to claim 15, said first and second side panel portions having a width, said first and second outer end panel portions having a width, the width of said first and second side panel portions being greater than the width of said first and second outer end panel portions.

* * * * *